US008556746B1

(12) United States Patent
DeMille et al.

(10) Patent No.: US 8,556,746 B1
(45) Date of Patent: Oct. 15, 2013

(54) GOLF CLUB HEAD

(75) Inventors: Brandon D. DeMille, Carlsbad, CA (US); Matthew T. Cackett, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 201 days.

(21) Appl. No.: 13/211,579

(22) Filed: Aug. 17, 2011

Related U.S. Application Data

(60) Provisional application No. 61/375,337, filed on Aug. 20, 2010, provisional application No. 61/376,632, filed on Aug. 24, 2010.

(51) Int. Cl.
*A63B 53/04* (2006.01)

(52) U.S. Cl.
USPC ..... 473/350; 473/349; 473/348; 473/345

(58) Field of Classification Search
USPC ..... 473/345, 348–350, 346
See application file for complete search history.

(56) References Cited

U.S. PATENT DOCUMENTS

| | | | | |
|---|---|---|---|---|
| 3,068,011 | A | 12/1962 | Sano | |
| 3,997,170 | A | 12/1976 | Goldberg | |
| 4,930,783 | A | 6/1990 | Antonious | |
| 5,735,754 | A | 4/1998 | Antonious | |
| 5,785,609 | A | 7/1998 | Sheets et al. | |
| 5,980,394 | A | 11/1999 | Domas | |
| 6,074,308 | A | 6/2000 | Domas | |
| 6,257,991 | B1 | 7/2001 | Ortiz | |
| 6,352,482 | B1 | 3/2002 | Jacobson et al. | |
| 6,458,042 | B1 | 10/2002 | Chen | |
| 6,881,292 | B2 * | 4/2005 | Chen | 156/293 |
| 6,964,617 | B2 * | 11/2005 | Williams | 473/245 |
| 6,974,393 | B2 | 12/2005 | Caldwell et al. | |
| 7,101,289 | B2 | 9/2006 | Gibbs et al. | |
| 7,137,907 | B2 | 11/2006 | Gibbs et al. | |
| 7,258,626 | B2 | 8/2007 | Gibbs et al. | |
| 7,422,528 | B2 | 9/2008 | Gibbs et al. | |
| 7,530,901 | B2 | 5/2009 | Imamoto et al. | |
| 7,572,193 | B2 | 8/2009 | Yokota | |
| 7,611,424 | B2 | 11/2009 | Nagai et al. | |
| 7,713,140 | B2 | 5/2010 | Gibbs et al. | |
| 7,713,143 | B2 * | 5/2010 | Evans | 473/334 |
| 8,337,328 | B2 * | 12/2012 | Foster et al. | 473/345 |
| 2005/0266933 | A1 * | 12/2005 | Galloway | 473/342 |
| 2010/0178997 | A1 | 7/2010 | Gibbs et al. | |
| 2010/0190573 | A1 | 7/2010 | Boyd | |
| 2013/0059678 | A1 | 3/2013 | Stites et al. | |
| 2013/0102410 | A1 | 4/2013 | Stites et al. | |
| 2013/0130834 | A1 | 5/2013 | Stites et al. | |

* cited by examiner

*Primary Examiner* — Benjamin Layno
(74) *Attorney, Agent, or Firm* — Rebecca Hanovice; Michael A. Catania; Sonia Lari

(57) ABSTRACT

A golf club (40) having a club head (42) with a face component (60), an aft body (61), and a sound modifying sole and crown design is disclosed herein. The face component, which may be composed of a metal material, (60) has a striking area portion (72) and a return portion (74). The aft-body (61), which may be composed of a non-metal material such as composite or thermoplastic material, is composed of a crown portion (62) and a sole portion (64). The sound modifying design, which may include deep pockets or pillars extending from the sole portion (64) to the crown portion (62), alters the sound of the golf club head (42) when it impacts a golf ball.

18 Claims, 9 Drawing Sheets

GOLF CLUB HEAD

CROSS REFERENCES TO RELATED APPLICATIONS

The present application claims priority to U.S. Provisional Patent Application No. 61/375,337, filed on Aug. 20, 2010. The present application also claims priority to U.S. Provisional Patent Application No. 61/376,632, filed on Aug. 24, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a multiple-material golf club head having sole and crown configurations that generate rigidity in the head to help with acoustics and structural requirements with minimal added mass. More specifically, the present invention relates to a golf club head with face component composed of a metal material for a more efficient transfer of energy to a golf ball at impact, a non-metallic aft-body to control the mass distribution, and a connection between the sole and crown at a location other than the periphery of the club head for altering the frequency, amplitude, and duration of the sound of the golf club head striking a golf ball, as well as improving the rigidity of the head.

2. Description of the Related Art

Technical innovation in the material, construction and performance of golf clubs has resulted in a variety of new products. The advent of metals as a structural material has largely replaced natural wood for wood-type golf club heads, and is but one example of this technical innovation resulting in a major change in the golf industry. Another important example is the use of composite or plastic materials to form components of golf club heads, including the face, crown, and/or sole.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. Complete descriptions of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e, which measures club face COR. This USGA test procedure, as well as procedures like it, may be used to measure club face COR.

Although the prior art has disclosed many variations of multiple material club heads, the prior art has failed to provide a multiple material club head with a high coefficient of restitution, greater forgiveness for the typical golfer, and a sound modifying component for a more pleasing sound when the golf club head strikes the golf ball.

BRIEF SUMMARY OF THE INVENTION

One aspect of the present invention is a golf club head comprising an aft-body body having a crown and a sole, and a face portion attached to the aft-body, the face portion comprising a striking area and a rear section extending laterally rearwardly from the striking face, wherein the rear section comprises a sole side, a crown side, a heel side, and a toe side, wherein the crown and the sole each have a periphery, wherein the crown and sole are connected to one another at one or more locations spaced inward from their respective peripheries. In another embodiment, the crown and sole are further connected to one another at their peripheries. In further embodiments, the crown and/or sole are composed of a composite material. In yet another embodiment, the face portion is composed of a titanium material. In yet another embodiment, the golf club head further comprises a ribbon disposed between and connected to the crown and the sole at their respective peripheries.

Another aspect of the present invention is a golf club head comprising a metal face cup comprising a ball striking area, a rear section extending laterally rearwardly from the striking area and encircling the striking area, and a hosel, a composite crown having a periphery, and a composite sole, wherein the composite sole is affixed to the composite crown at the periphery and at one or more locations on the crown spaced from the periphery.

Yet another aspect of the present invention is a golf club head comprising a face component composed of a titanium alloy material and comprising a ball striking area, a rear section extending laterally rearwardly from a periphery of the striking area and encircling the striking area, and a hosel, a composite crown having an inner surface, an outer surface, an interior area, and a periphery, and a composite sole having an inner surface, an outer surface, an interior area, and a periphery, wherein the composite sole and the composite crown are attached to each other at their respective peripheries, and wherein one or more portions of the composite sole located within an interior area of the composite sole extend upwards towards and connect with the inner surface of the composite crown at one or more points located within the interior area of the crown.

Another aspect of the present invention is a golf club head comprising a face component, a composite crown 62 comprising interior 260 and exterior surfaces, a composite sole 220 comprising one or more apertures 250, 255, and one or more composite pieces 270, 275 having approximately the same size in plan as the one or more apertures 250, 255 and having a plurality of sides 272, 274, 276, 278, wherein the interior surface 260 of the crown 62 is visible through the one or more apertures 250, 255, wherein at least one side 272, 274, 276, 278 of each of the one or more composite pieces 270, 275 is affixed to at least one side 252, 254 of each of the one or more apertures 250, 255, and wherein at least one side 272, 274, 276, 278 of each composite piece 270, 275 is affixed to the interior surface 260 of the composite crown 62.

Yet another aspect of the present invention is a golf club head comprising a face component, a composite crown comprising interior and exterior surfaces, a composite sole comprising at least one aperture, and a composite cutout having approximately the same size in plan as the aperture, wherein the interior surface of the crown is visible through the aperture and wherein the composite cutout is affixed to a side of the aperture at a first location and to the interior surface of the crown at a second location.

Another aspect of the present invention is a golf club head comprising a face component, a composite crown comprising interior and exterior surfaces, and a composite sole comprising at least one deep pocket, wherein the at least one deep pocket comprises interior and exterior surfaces, and wherein a portion of the interior surface of the at least one deep pocket contacts a portion of the interior surface of the composite crown. In a further embodiment, the composite sole comprises two deep pockets. In yet another embodiment, the composite sole comprises four deep pockets.

DETAILED DESCRIPTION OF THE INVENTION

The present invention is generally directed to a multi-material golf club head that has interior structural means for generating rigidity in the head to help with acoustics or structural requirements with minimal added mass. The structural means alters the sound emitted from the golf club head when the club strikes a golf ball.

Figure 1:
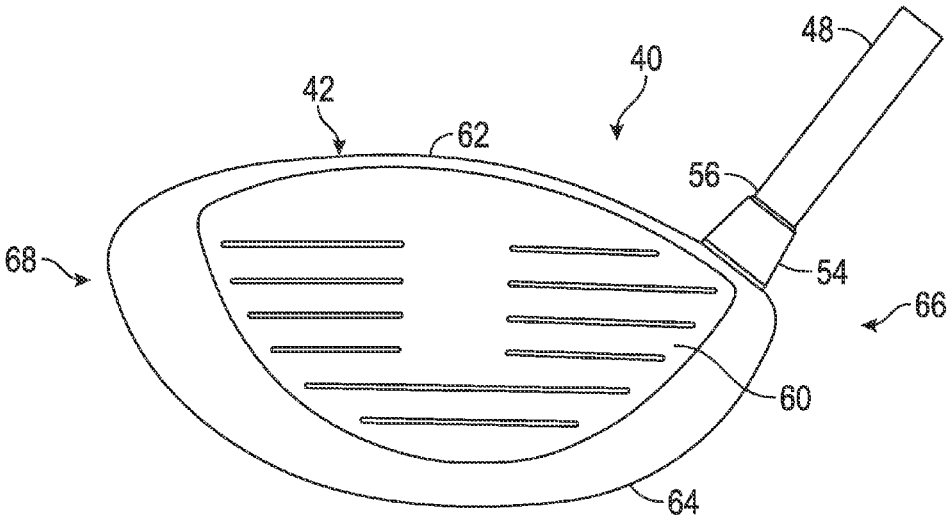
FIG. 1 is a front view of a golf club according to an embodiment of the present invention.
Figure 2:
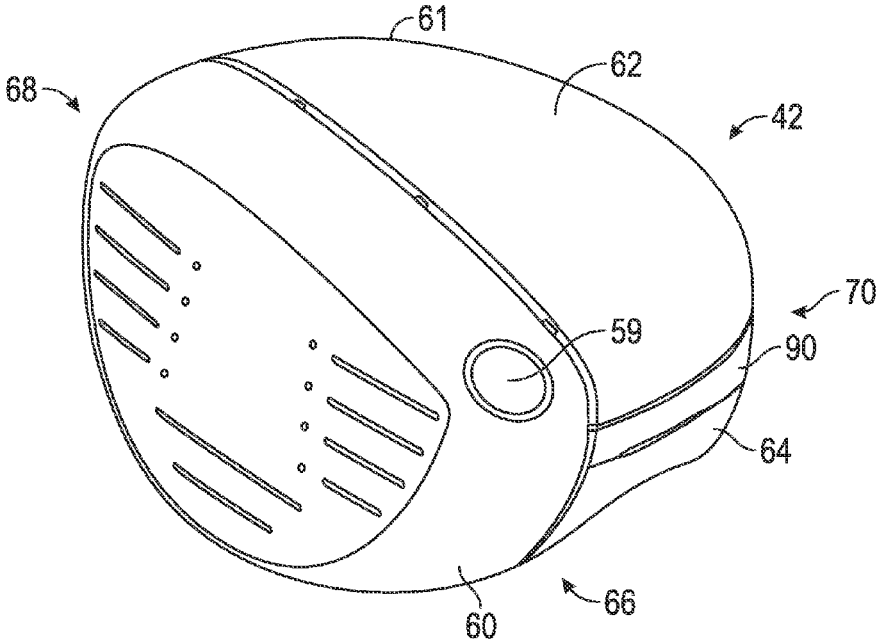
FIG. 2 is a top perspective view of the heel side of a golf club head according to an embodiment of the present invention.
Figure 3:
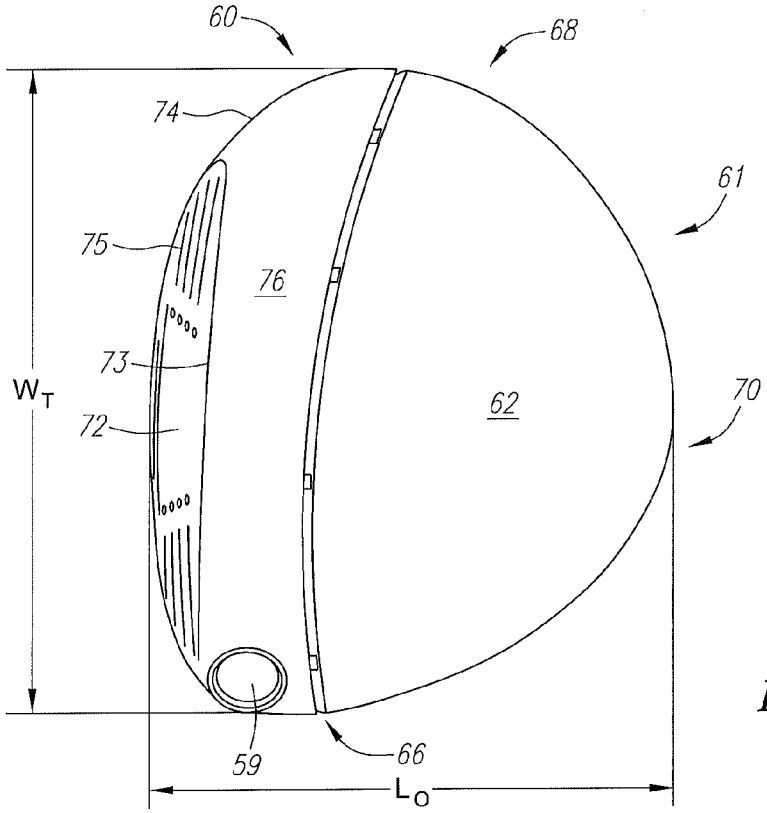
FIG. 3 is a top plan view of the golf club head of FIG. 2.
Figure 4:
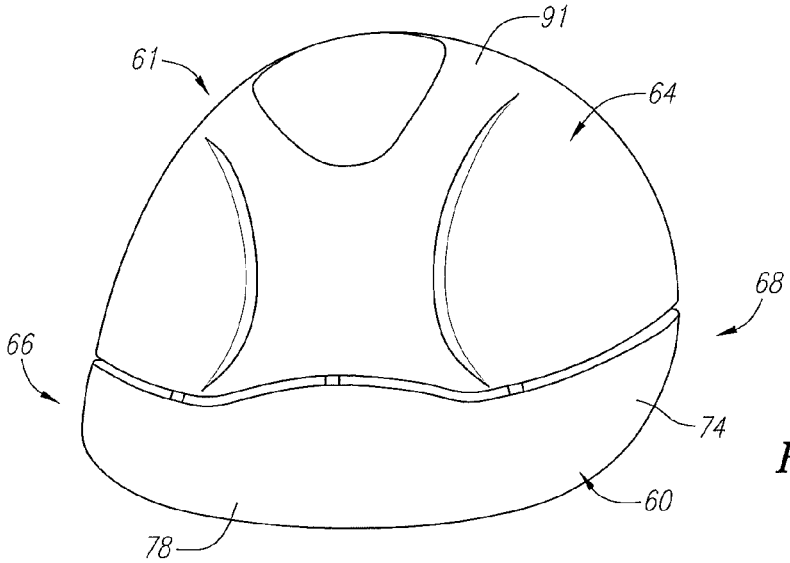
FIG. 4 is a sole plan view of the golf club head of FIG. 2.

As shown in FIGS. 1-2, a golf club is generally designated 40. The golf club 40 has a golf club head 42 with a hollow interior (not shown). As shown in FIG. 1, engaging the club head 42 is a shaft 48 that has a grip (not shown) at a butt end and is inserted 10 into a hosel 54 at a tip end 56. Alternatively, as shown in FIG. 2, the club head has a shaft receiving aperture 59 for receiving the shaft 48. The club head 42 is generally composed of three components: a face component 60; a crown 62; and a sole portion 64. The club head 42 also may optionally have a ribbon 90, skirt, or side portion disposed between the crown 62 and sole 64 portions. The golf club head 42 is preferably partitioned into a heel section 66 nearest the shaft 48, a toe section 68 opposite the heel section 66, and a rear section 70 opposite the face component 60. The crown 62 and sole 64 are connected to form an aft body 61.

As shown in FIGS. 3-8, the face component 60 generally includes a striking portion 72 (which may also be referred to as a face plate) and a return portion 74 extending laterally inward from the perimeter of the striking plate portion 72. The striking portion 72 typically has a plurality of scorelines 75 thereon. The face component 60 is generally composed of a single piece of metal, and is preferably composed of a cast metal material. More preferably, the cast metal material is a titanium material, which may include pure titanium or titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals that can be used for the face component 60 include stainless steel, other high strength steel alloy metals and amorphous metals. The casting process used to form the face component may be the well-known lost-wax casting method, or other methods. Alternatively, the face component 60 may be manufactured through forging, forming, machining, powdered metal forming, metal-injection-molding, electro chemical milling, and the like.

Figure 5:
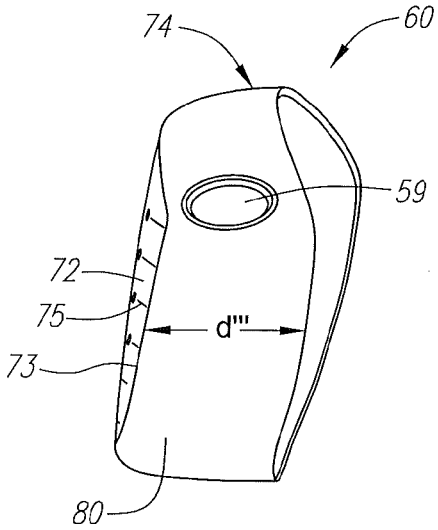
FIG. 5 is a heel side view of a face component according to an embodiment of the present invention.
Figure 6:
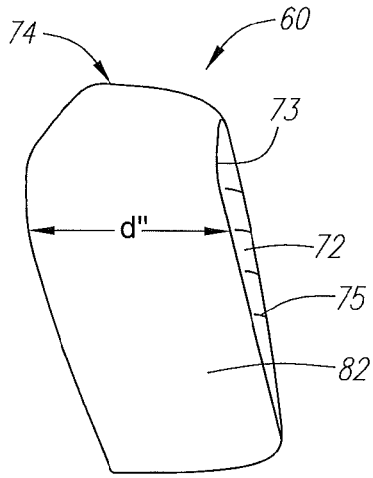
FIG. 6 is a toe side view of a face component according to an embodiment of the present invention.

In a preferred embodiment, the return portion 74 generally includes an upper lateral section 76 (illustrated in FIG. 7), a lower lateral section 78 (illustrated in FIG. 8), a heel lateral section 80 (illustrated in FIG. 5) and a toe lateral section 82 (illustrated in FIG. 6). Thus, the return portion 74 preferably encircles the striking plate portion 72 a full 360 degrees. However, those skilled in the pertinent art will recognize that the return portion 74 may only encompass a partial section of the striking plate portion 72, such as 270 degrees or 180 degrees, and may also be discontinuous. In yet another embodiment, the face component 60 may not have a return portion 74 at all and may consist only of a striking portion 72.

Figure 7:
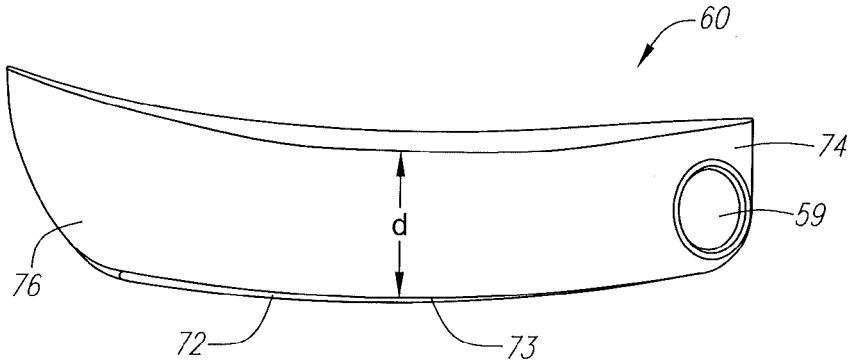
FIG. 7 is a top plan view of a face component according to an embodiment of the present invention.

As illustrated in FIG. 7, the upper lateral section 76 extends inward, towards the aft-body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the striking plate portion 72 to the rearward edge of the upper lateral section 76. In a preferred embodiment, the upper lateral section 76 has a general curvature from the heel section 66 to the toe section 68. The upper lateral section 76 has a distance d from the perimeter 73 of the striking plate section 72 that is preferably a minimal length near the center of the striking plate section 72, and increases toward the toe section 68 and the heel section 66.

The perimeter 73 of the striking plate portion 74 is defined as the transition point where the face component 60 transitions from a plane substantially parallel to the striking plate portion 72 to a plane substantially perpendicular to the striking plate portion 72. Alternatively, one method for determining the transition point is to take a plane parallel to the striking plate portion 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking plate portion 72. The present invention preferably has the face component 60 engage the crown 62 along a substantially horizontal plane.

Figure 11:
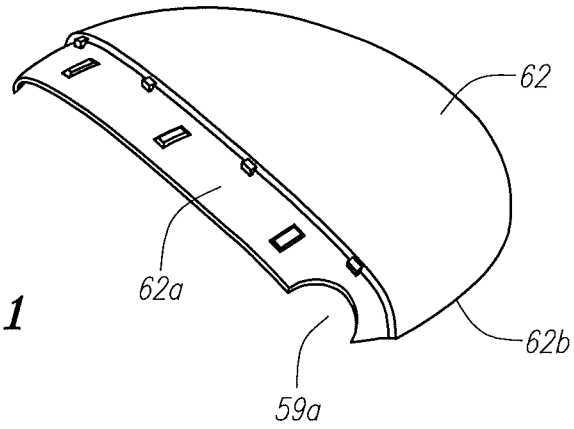
FIG. 11 is a top perspective view of the crown of the golf club head of FIG. 2.
Figure 12:
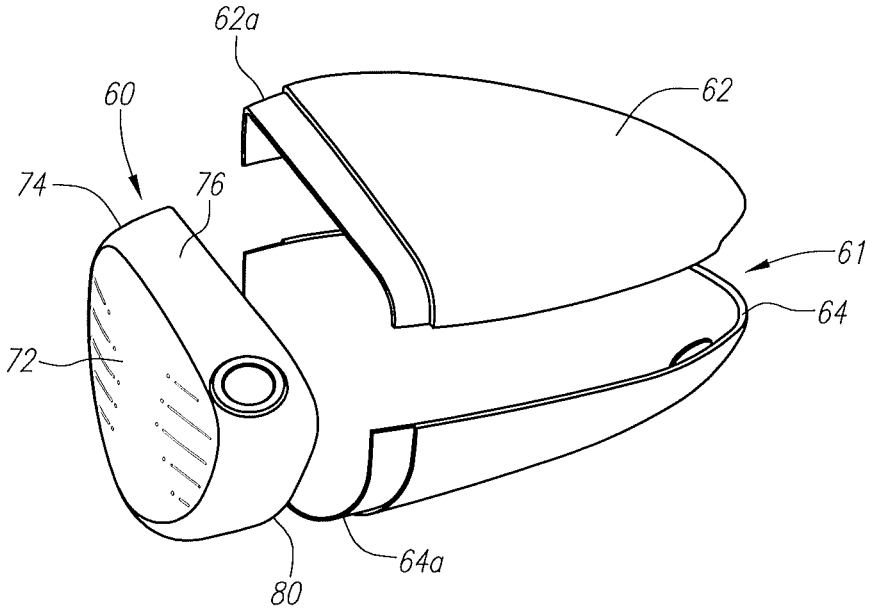
FIG. 12 is an exploded view of the face component, crown, and sole of a golf club head according to an embodiment of the present invention.

As shown in FIGS. 11 and 12, the crown 62 has a crown undercut portion 62*a*, which is placed under the upper lateral section 76, and a periphery 62*b*. Such an engagement enhances the flexibility of the striking plate portion 72 allowing for a greater coefficient of restitution. In a preferred embodiment, the crown 62 and the upper lateral section 76 are attached to each other with an epoxy material.

As illustrated in FIG. 5, the heel lateral section 80 is substantially perpendicular to the striking plate portion 72, and the heel lateral section 80 covers the hosel 54 before engaging the aft-body 61. In a preferred embodiment, the heel lateral section 80 is attached to the sole 64 and crown 62 with an epoxy material. If the golf club head 42 includes a ribbon, then the heel lateral section 80 is further attached to the ribbon. The heel lateral section 80 extends inward a distance, d'", from the perimeter 73 a distance of 0.250 inch to 1.50 inches, more preferably 0.50 inch to 1.0 inch, and most preferably 0.950 inch. The heel lateral section 80 preferably has a general curvature at its edge.

As shown in FIG. 6, the toe lateral section 82 is at the other end of the face component 60. In a preferred embodiment, the toe lateral section 82 is attached to the sole 64 and the crown 62 with an epoxy material. If the golf club head 42 includes a ribbon, then the toe lateral section 82 is further attached to the ribbon. The toe lateral section 82 extends inward a distance, d", from the perimeter 73 a distance of 0.250 inch to 1.50 inches, more preferably 0.75 inch to 1.30 inch, and 15 most preferably 1.20 inch. The toe lateral section 80 preferably has a general curvature at its edge.

Figure 8:
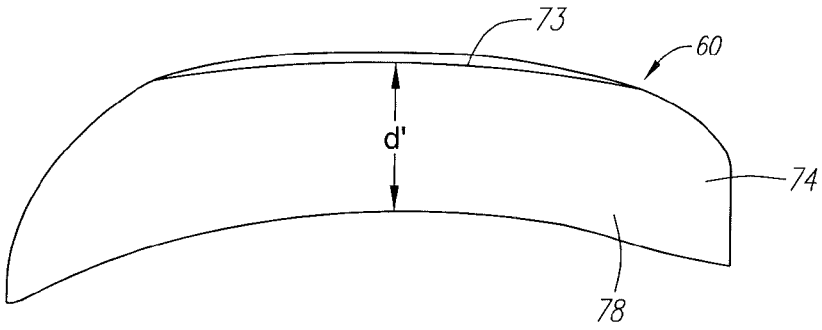
FIG. 8 is a bottom plan view of a face component according to an embodiment of the present invention.
Figure 13:
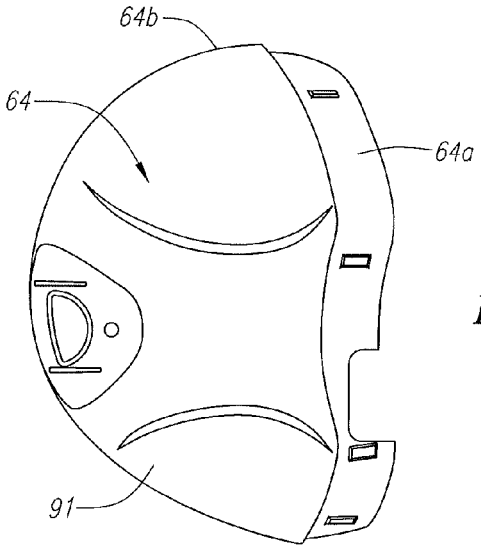
FIG. 13 is a bottom plan view of a sole according to an embodiment of the present invention.

As shown in FIG. 8, the lower lateral section 78 extends inward, toward the aft-body 61, a distance, d', to engage the sole 64. In a preferred embodiment, the distance d' ranges from 0.2 inch to 1.25 inches, more preferably 0.50 inch to 1.10 inch, and most preferably 0.9 inch, as measured from the perimeter 73 of the striking plate portion 72 to the edge of the lower lateral section 78. As illustrated in FIG. 13, the sole portion 64 has a sole undercut 64*a* for placement under the lower lateral section 78, and a periphery 64*b*. In a preferred embodiment, the sole 64 and the lower lateral section 78, the heel lateral section 80, and the toe lateral section 82 are attached to each other with an epoxy material.

Figure 9:
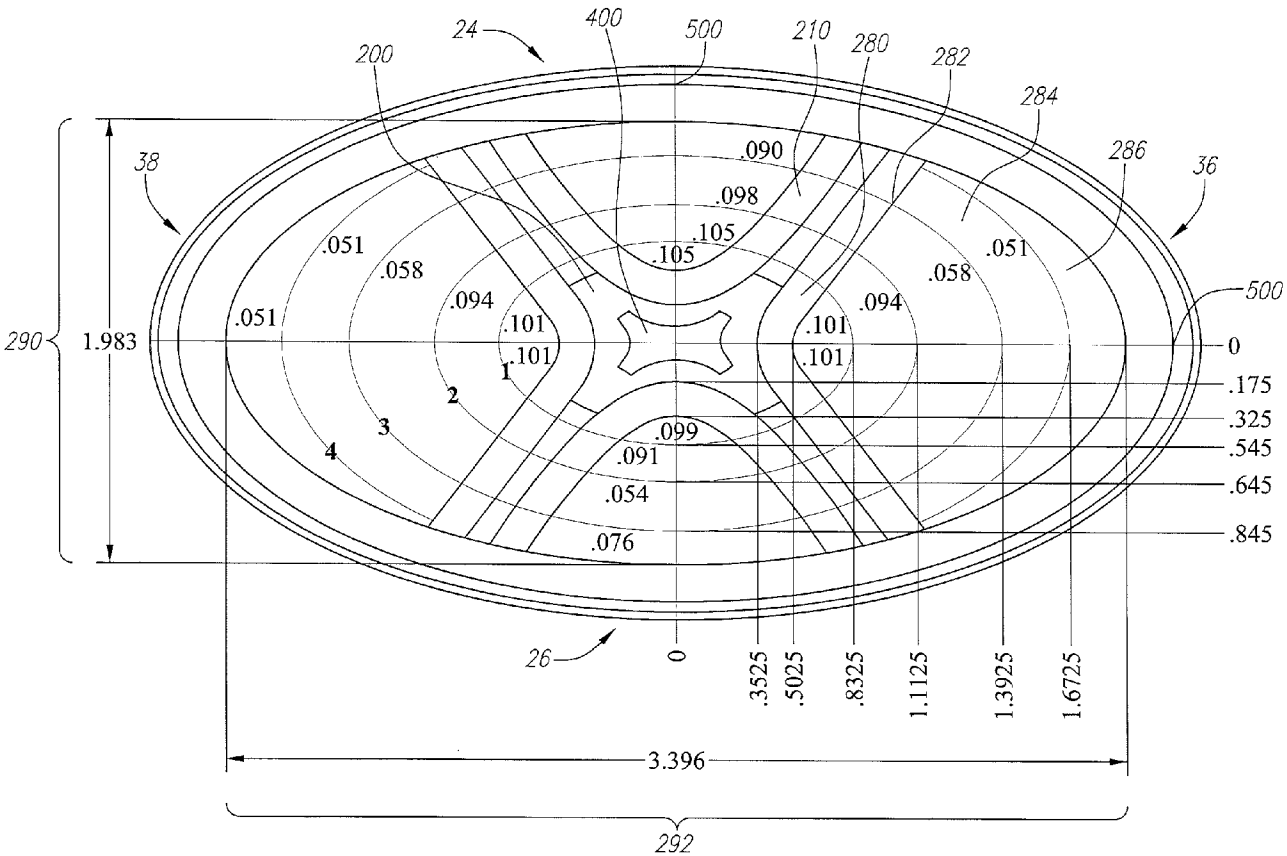
FIG. 9 is a plan isolated view of an interior surface of the face component according to an embodiment of the present invention.

FIG. 9 shows a rear surface of the striking portion 72 of the face component 60 and illustrates thickness variation of the striking portion. In a most preferred embodiment, the striking portion 72 preferably has the thickness distribution disclosed in FIG. 9, e.g., a hyperbolic X pattern combined with elliptical thickness rings as disclosed in U.S. Patent Application Publication No. 2010/0178997, the disclosure of which is hereby incorporated in its entirety herein. In other embodiments, the thickness distributions of the striking portion 72 are consistent with those disclosed in U.S. Pat. Nos. 7,137,907, 7,101,289, 725,826, 7,422,528, 7,713,140, the disclosures of which are hereby incorporated in their entireties herein.

Figure 10:
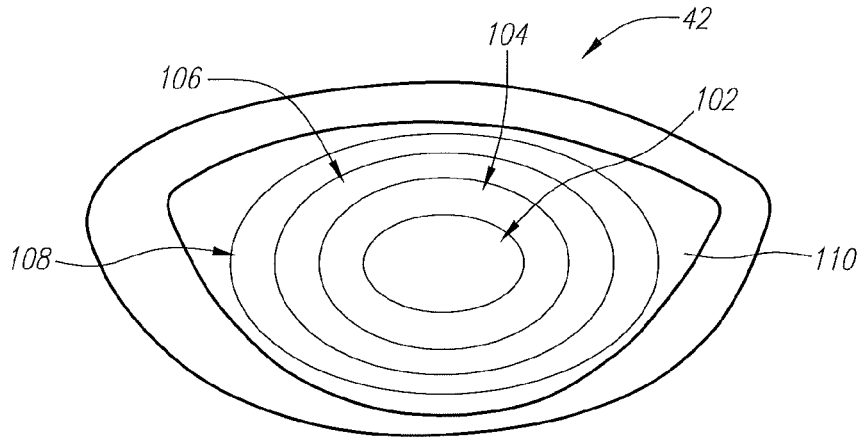
FIG. 10 is an interior view of a face component according to an embodiment of the present invention.

In yet another embodiment, shown in FIG. 10, the striking portion 72 of the face component 60 includes a central elliptical region 102 with the greatest thickness ranging from 0.170 inch to 0.090 inch. The central elliptical region 102 preferably has uniform thickness, but its thickness may vary. The elliptical rings encircling the central elliptical region 104, 106, 108, and the periphery 110 have thicknesses that decrease in direct proportion to their distance from the central elliptical region 102.

Figure 14:
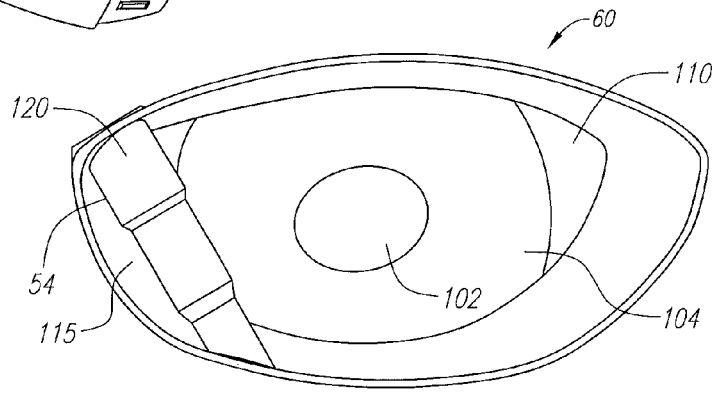
FIG. 14 is an interior view of a face component according to an embodiment of the present invention.
Figure 15:
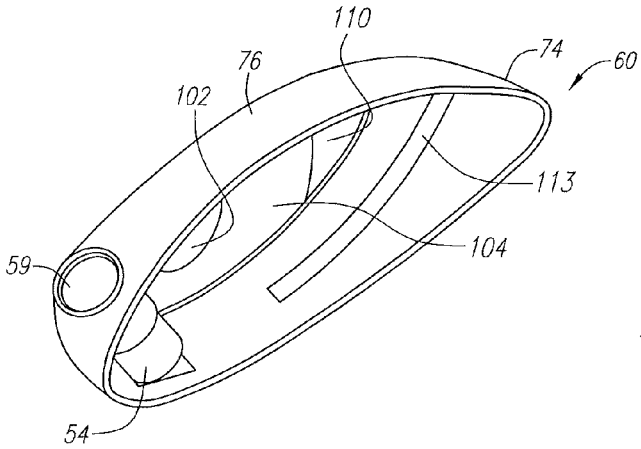
FIG. 15 is a heel side perspective view of a face component according to an embodiment of the present invention.

FIGS. 14-15 illustrate the interior of the face component 60 of the present invention. The hosel 54 is disposed within the interior and is located as a part of the face component 60. The hosel 54 preferably is composed of the same material as the face component 60, and is preferably integrally cast with the face component 60. Alternatively, the hosel may be composed of a different or non-similar material that is light weight and secured using bonding or other mechanical securing techniques. A hollow interior of the hosel 54 is defined by a hosel wall 120 that forms a tapering tube from the aperture 59 that may or may not connect with the sole potion 64. In a preferred embodiment, the hosel wall 120 does not connect with the sole portion 64. Also in a preferred embodiment, the hosel wall 120 does not engage the heel lateral section 80, thereby leaving a void 115 between the hosel wall 120 and the heel lateral section 80. The shaft 48 is disposed within a hosel insert that is disposed within the hosel 54. Such a hosel insert and hosel 54 are described in U.S. Pat. No. 6,352,482, filed on Aug. 31, 2000, entitled Golf Club With Hosel Liner, which pertinent parts are hereby incorporated by reference herein. Further, the hosel 54 is preferably located rearward from the striking plate portion 72 in order to allow for compliance of the striking plate portion 72 during impact with a golf ball. In one embodiment, the hosel 54 is disposed 0.125 inch rearward from the striking plate portion 72.

FIG. 12 illustrates the preferred embodiment of the aft-body 61. The aft-body 61 is composed of a non-metal material, preferably a carbon fiber composite material. A preferred material for use to form the aft-body is a chopped carbon fiber reinforced ESC molding compound sold by the Quantum Composites company under the brand name AMC 8593 (XP126-76-113). Other materials for the aft-body 61 include other thermosetting materials or other thermoplastic materials such as injectable plastics. The aft-body 61 may be manufactured through bladder-molding, resin transfer molding, resin infusion, injection molding, compression molding, or a similar process.

Figure 16:
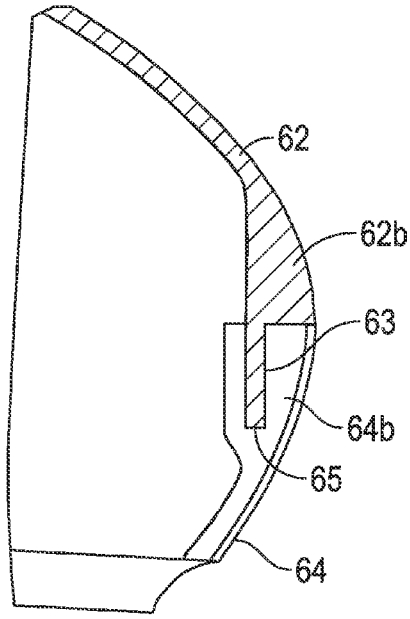
FIG. 16 is a cross-sectional view of an aft body according to an embodiment of the present invention.

In a preferred process, the crown 62 and sole 64 are separately formed through compression molding and are attached together at their respective peripheries 62*b*, 64*b* with an adhesive material. FIG. 16 illustrates the preferred manner in which the crown 62 and sole 64 are connected to one another by their respective peripheries 62*b*, 64*b*. As shown in FIG. 16, the sole periphery 64*b* includes a recess 65 that receives an extension portion 63 extending from the crown periphery 62*b*. The extension portion 63 is affixed to the recess using an adhesive. Such adhesives include thermosetting adhesives in a liquid or a film medium. One kind of adhesive that can be used with the present invention is a two part liquid epoxy sold by 3M of Minneapolis Minn., under the brand names P420NS and DP460NS. A preferred adhesive is a modified acrylic liquid adhesive also sold by the 3M company under the brand name DP810NS. Alternatively, foam tapes such as Hysol Synspan may be utilized with the present invention.

The crown portion 62 of the aft-body 61 is generally convex toward the sole portion 64, and preferably engages the sole portion 64 at the periphery of the sole portion 64*b*. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.035 inch. Where an optional ribbon is used, the crown portion engages the ribbon instead of the sole portion periphery 64*b*.

The sole portion 64 of the aft-body 61 preferably engages the crown portion 62 at the periphery of the crown portion 62*b*. The sole portion 64 preferably has a thickness in the range of 0.010 to 0.100 inch, more preferably in the range of 0.025 inch to 0.070 inch, even more preferably in the range of 0.030 inch to 0.050 inch, and most preferably has a thickness of 0.040 inch. Where an optional ribbon is used, the sole portion 64 engages the periphery ribbon 90 instead of the crown portion 62.

Figure 17:
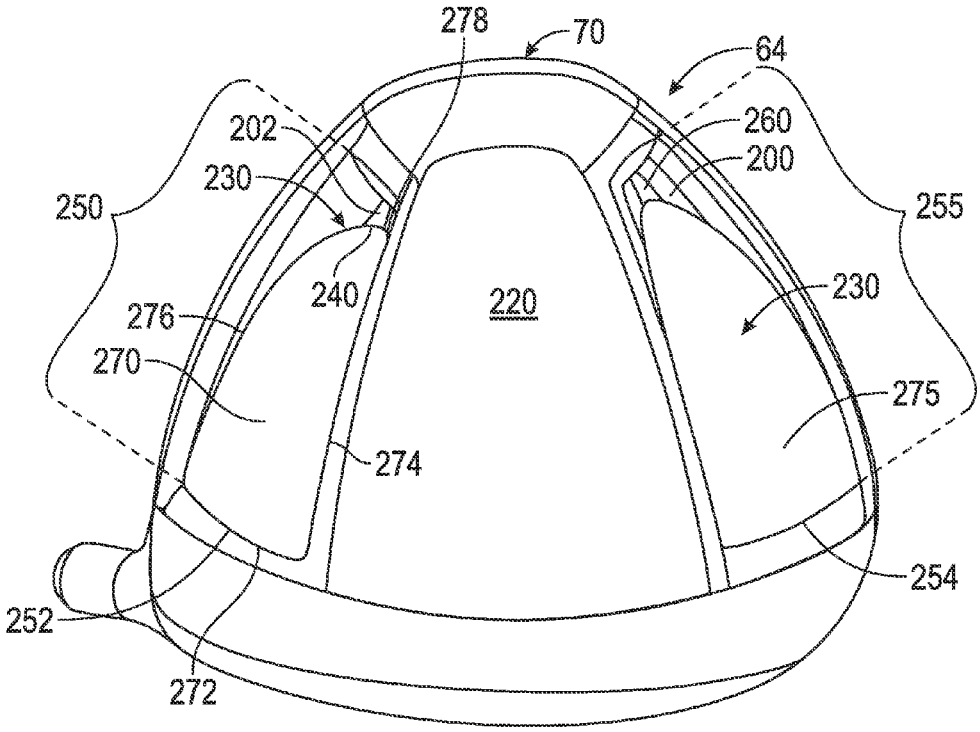
FIG. 17 is a bottom plan view of a sole according to an embodiment of the present invention.
Figure 18:
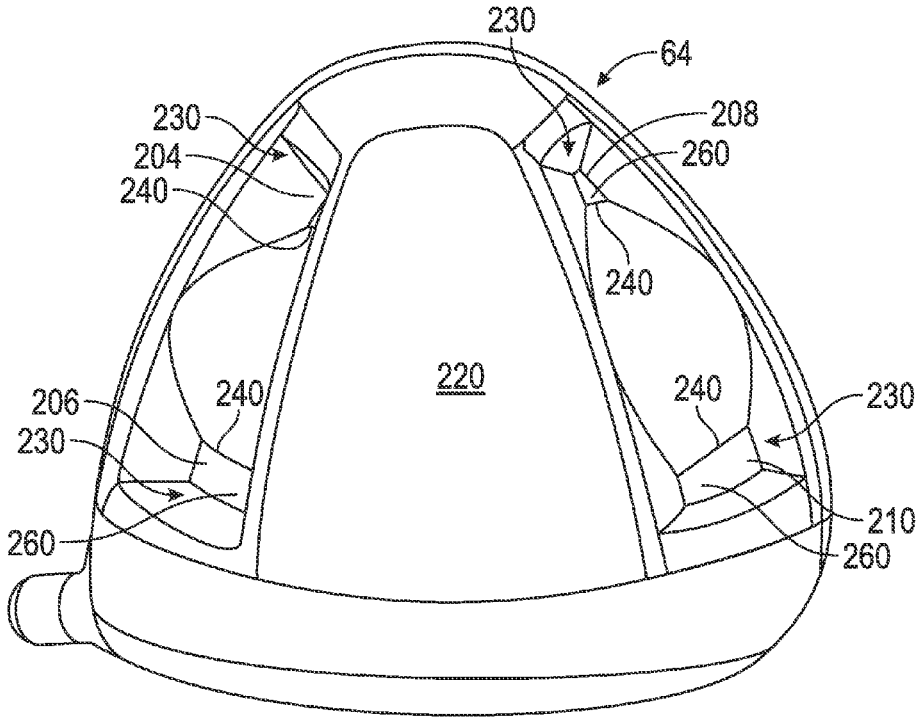
FIG. 18 is a bottom plan view of a sole according to another embodiment of the present invention.

As illustrated in FIGS. 17 and 18, and in accordance with the invention, the aft-body 61 further comprises an internal structure whereby the sole 64 is joined to the crown 62 at one or more locations other than the crown and sole peripheries 62*b*, 64*b*. In a preferred embodiment, the sole portion 64 comprises deep pockets 200, 202, 204, 206, 208, 201 that extend upwards from a planar area of the sole 220 and contact an interior surface 260 of the crown 62. In one embodiment, the openings 230 formed by the deep pockets may be covered on the sole 64 side such that they are not visible to a golfer, but in a preferred embodiment they are uncovered. In another embodiment, the sole portion 64 comprises pillars or ribs that extend upwards from the planar area of the sole and contact the interior surface 260 of the crown 62. In yet another embodiment, the sole 64 includes one or more apertures 250, 255 and the pockets 200-210 are formed by inserting into the apertures 250, 255 one or more composite pieces 270, 275 having approximately the same size in plan as the apertures 250, 255 and using the composite pieces 270, 275 to connect the sole 64 with the interior surface 260 of the crown 62.

In a most preferred embodiment, the deep pockets 200-210 are located on the sole 64 near the rear of the head 70 where the interior space between the crown 62 and the sole 64 is generally smallest. FIG. 17 shows an embodiment having a sole 64 with two deep pockets 200, 202. The club head could include any number of pockets, however. For example, FIG. 18 shows an embodiment of the golf club head 42 having a sole 64 with four deep pockets 204, 206, 208, 210. The deep pockets 200-210 preferably have a cumulative volume that is less than 50 cubic centimeters, more preferably a cumulative volume that is less than 30 cubic centimeters, and most preferably a cumulative volume that is less than 15 cubic centimeters.

In the preferred embodiment, the crown 62 and sole 64 comprising the deep pockets 200-210 are formed using a compression molding process, where the crown 62 and sole 64 are molded as two separate pieces, then bonded together afterwards. The joint 240 at the bottom of the pocket 200-210 where the sole 64 connects to the crown 62 could be configured a number of ways. The sole 64 could have holes in it as shown in FIGS. 17-18 and the base of the pocket 200-210 would actually be the interior surface of the crown 62. In an alternative embodiment, the bottom of the pocket 200-210 is enclosed and the surface is bonded to the interior surface of the crown 62, such that the base of the pocket 200-210 is double layered. The bonding step between the base of the pockets 200-210 and the crown 62 preferably occurs at the same time as the rest of the bonding between the crown 62 and the sole 64.

In yet another embodiment, the interior surface of the crown 62 may comprise alignment features to assist in alignment of the sole with respect to the crown and to increase the available bond surface area between the two parts. The bonding step between the base of the pockets and the crown will likely occur at the same time as the rest of the bonding between the crown and the sole.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

an aft body comprising a crown and a sole; and a face portion attached to the aft body, the face portion comprising a striking area and a rear section extending laterally rearwardly from the striking face;

wherein the rear section comprises a sole side, a crown side, a heel side, and a toe side;

wherein the crown and the sole each have a periphery and are connected to one another at their peripheries;

wherein the crown and sole are connected to one another at one or more locations spaced inward from their respective peripheries to form at least one deep pocket; and wherein an interior surface of the crown is visible through the at least one deep pocket.

2. The golf club head of claim 1, wherein the crown is composed of a composite material.

3. The golf club head of claim 1, wherein the sole is composed of a composite material.

4. The golf club head of claim 1, wherein the face portion is composed of a titanium material.

5. The golf club head of claim 1, further comprising a ribbon disposed between and connected to the crown and the sole at their respective peripheries.

6. The golf club of claim 1, wherein the face portion is a face cup.

7. The golf club of claim 6, wherein the face cup is composed of a titanium alloy material.

8. A golf club head comprising:

a face component;

a composite crown comprising interior and exterior surfaces and a periphery;

a composite sole comprising one or more apertures and a periphery; and one or more composite pieces having approximately the same size in plan as the one or more apertures and having at least three sides;

wherein the interior surface of the crown is visible through the one or more apertures;

wherein at least one side of each of the one or more composite pieces is affixed to at least one side of each of the one or more apertures; and wherein at least one side of each of the one or more composite pieces is affixed to the interior surface of the composite crown.

9. The golf club head of claim 8, wherein the face component is a face cup.

10. The golf club head of claim 8, wherein the face component is a face plate.

11. The golf club head of claim 8, wherein the face component is composed of a titanium material.

12. The golf club head of claim 8, further comprising a ribbon disposed between and connected to the crown and the sole at their respective peripheries.

13. The golf club head of claim 8, wherein the crown and sole are connected to one another at their respective peripheries.

14. A golf club head comprising a face component;

a composite crown comprising interior and exterior surfaces; and a composite sole comprising at least one deep pocket;

wherein the at least one deep pocket comprises interior and exterior surfaces; and wherein a portion of the interior surface of the at least one deep pocket contacts a portion of the interior surface of the composite crown.

15. The golf club head of claim 14, wherein the composite sole comprises two deep pockets.

16. The golf club head of claim 14, wherein the composite sole comprises four deep pockets.

17. The golf club head of claim 14, wherein a cumulative volume of the at least one deep pocket is less than or equal to 15 cubic centimeters.

18. The golf club head of claim 14, wherein the crown and the sole each have a periphery, and wherein the crown and sole are connected to each other at their respective peripheries.

* * * * *